United States Patent [19]

Johansson et al.

[11] 4,300,111

[45] Nov. 10, 1981

[54] DEVICE IN IGNITION COILS

[76] Inventors: Sven H. Johansson, Kompassgatan 12; Knut E. M. Jansson, Diskusgatan 16, both of 662 00 Amal, Sweden

[21] Appl. No.: 18,186

[22] Filed: Mar. 7, 1979

[30] Foreign Application Priority Data

Mar. 7, 1978 [SE] Sweden ..... 7802588

[51] Int. Cl.[3] ..... H01F 27/04; H01F 15/10

[52] U.S. Cl. ..... 336/96; 336/107; 339/61 R

[58] Field of Search ..... 336/96, 205, 105, 107, 336/192; 174/77 S, 35 SM; 123/148 A, 148 D, 169 R, 169 P, 169 PA, 634, 635; 339/26, 61 R, 61 M, 228; 310/152

[56] References Cited

U.S. PATENT DOCUMENTS

| | | | |
|---|---|---|---|
| 995,400 | 6/1911 | Cavanagh | 123/148 A |
| 1,326,366 | 12/1919 | Milton | 123/148 A |
| 2,648,030 | 8/1953 | Kiekhaefer | 174/77 S X |
| 3,311,783 | 3/1967 | Gibbs et al. | 310/152 X |
| 3,673,543 | 6/1972 | Garner | 339/61 M |
| 3,686,607 | 8/1972 | Berry | 123/148 D X |
| 3,716,038 | 2/1973 | Bevacqua | 123/148 A |
| 3,935,852 | 2/1976 | Donovan et al. | 123/148 A |

*Primary Examiner*—Thomas J. Kozma

*Attorney, Agent, or Firm*—Hill, Van Santen, Steadman, Chiara & Simpson

[57] ABSTRACT

An ignition coil for a single spark plug includes a coil from which a contact terminal projects, the coil and contact terminal being carried by an elastic body, such as an elastomer, that has a cavity in which the terminal is disposed and which is receptive of the contact and at least a portion of the insulator of the spark plug whereby a seal is provided therewith, there being a sprung coaction with the spark plug, thus eliminating high voltage wiring from the ignition system.

5 Claims, 6 Drawing Figures

DEVICE IN IGNITION COILS

BACKGROUND OF THE INVENTION

1. Field of the Invention

The present invention refers to ignition coils.

2. Prior Art

The engines of portable motorized saws or chainsaws are today very small in their outer dimensions, so that the ignition apparatus comprising the flywheel magneto must of necessity have very small dimensions. However, it is very difficult to accommodate an ignition coil inside a flywheel casing, and it must therefore be placed somewhere else. The coils in known apparatus, which are arranged inside the flywheel magneto casing, are automatically cooled by the rotation of the flywheel. An exteriorly mounted coil is generally fitted on or close to the engine block. Undesirable engine heat is thus transmitted to the coil. If the coil is placed on the chainsaw frame, the cables to it will unavoidably be relatively long, and as a result of the high frequency vibrations at very high revolutions, vibrations interrupting electrical contact easily arise, especially in the high-tension cable from the transformer, causing uneven running of the engine or complete operational breakdown. Neither is it desirable to arrange long high-tension cables in, or in the vicinity of, the saw frame, with the accompanying risk of spark-over. As is well-known, a chainsaw most often operates under severe conditions with respect to moisture and vibrations.

There are already many proposals for building a spark plug and an ignition coil together. The disadvantages of these assemblies is that the coils are subjected to severe heating as well as heavy vibrations, and the requirement for winding strength in such arrangements is therefore extremely difficult to meet. There is otherwise a great deal to gain by building the spark plug together with the ignition coil. High-tension cables can be avoided altogether, and it is easy to achieve great security against the entry of moisture when the devices are properly encased. A disadvantage is, however, that special spark plugs including the built-on ignition coil must be manufactured.

The present invention relates to a simple and well-adapted solution of the problems mentioned above, in which there are all the advantages of a unified assembly of the plug and coil, and none of the disadvantages mentioned hereinbefore.

An embodiment of the invention is described in detail with reference to the accompanying drawing.

Figure 1:
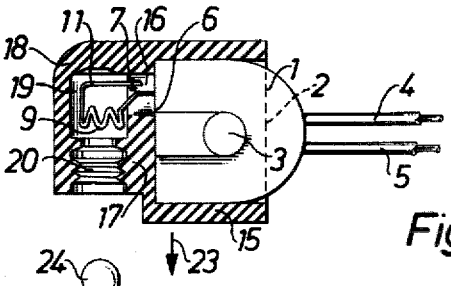
FIG. 1 is a longitudinal explosion view partly in section, of a device according to the invention, together with a spark plug intended for coaction with the device.
Figure 2:
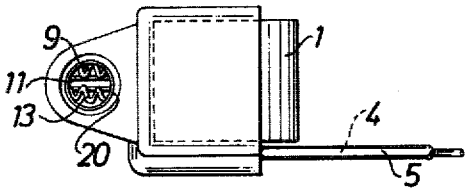
FIG. 2 is a bottom view of the device of FIG. 1.
Figure 2:
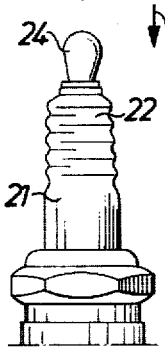
Figure 3:
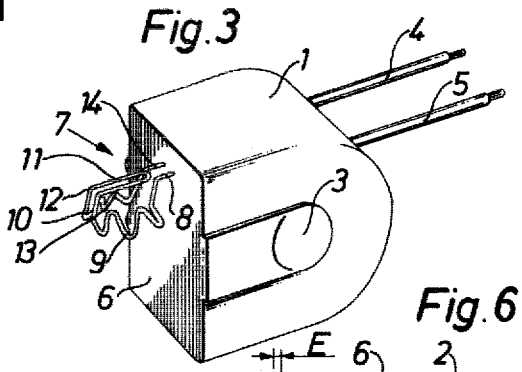
FIG. 3 is a perspective view thereof.

The device shown in FIG. 1 comprises an ignition coil 2 on a core 3, encapsulated in a casing 1. A pair of connection wires 4,5 are connected to the primary winding of the coil 2. The right-hand end, on the drawing, of the casing 1 is formed to the shape of the coil, while the opposite end is formed with a flat end surface 6, from the upper portion of which projects a wire structure 7, for forming a high-tension contact clip attachable to the spark plug. The actual construction of the clip is shown in FIG. 3. A first wire portion 8 projects perpendicularly from the wall 6 and is bent sideways to form a wavy portion 9 which, by means of an upwardly directed portion 10, merges into an overlaying tongue formed by a wire loop 11, the tongue merging into a second vertical portion parallel to the wire portion 10 and thereafter forming a wavy portion 13 opposite to the portion 9, to finally run in through the wall 6 in a straight portion 14. The parallel wire portions 8 and 14 are connected to the secondary or high-tension winding of the coil inside the casing 1.

As shown in FIG. 1, the casing 1 has a pressed-on body 15 made from elastic material such as an elastomer, and formed with an opening 16 in a wall 17 facing towards the surface 6, for the free passage of the contact clip 7. A sleeve or sleeve-like portion 18 extends from the portion 17, to surround the clip 7 and forms a chamber 19. The downwardly directed portion of this chamber 19 is formed with annular ridges 20 for reaction with configurations 22 on a spark plug 21. When the device is put over the spark plug in the direction of the arrow 23, a contact stud 24 on the central electrode of the plug 21 is received in the upper portion of the chamber 19, the configurations 22 coact with the ridges 20, and the stud 24 is pressed into the space between the wavy wire portions 9 and 13 until the stud 24 has reached the tongue-like wire portion 11. In this position, the spark plug 21 and the sleeve 18 coact in such a way that the plug and clip 7 are kept in engagement for mutual coaction. The wire contact structure of the clip lies around the stud 24 with spring bias. Since the body and sleeve means 15, 18 is of elastic material, a moisture-proof connection is obtained between the plug insulator and the sleeve 18. Moisture cannot creep into the cavity 19, which accommodates the high-tension contacts.

Figure 4:
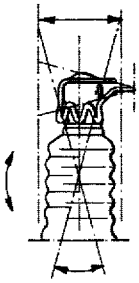
FIG. 4 is a diagram of the plug vibrations when it coacts with the device.

If it is assumed that the device is retained by some frame portion of the saw, there would be, due to the resilient connection between the plug and the coil, a degree of freedom for the cylinder vibrations arising from the engine when it is in operation. As shown in FIG. 4, there would be a certain amount of movement in all directions. However, the elastic portion 18 gently dampens vibration movements. The portion 18 has such elasticity that movement is permitted in the directions shown in FIG. 4 only to an extent which does not exceed deformation of the high-tension contact or clip means 7. The clip means 7 accompanies all these movements, and oscillates about its point of attachment in the wall 16. Since the clip means comprises two cantilevered parallel wires 8 and 14, oscillation is also permitted in a plane parallel to a plane through the wires, simultaneously as continuous contact with the central electrode is ensured by the sprung construction. If the engine thus has rubber suspension in relation to the saw frame, a moisture-proof and electrically secure connection is provided between the coil and plug by the device shown.

Figure 5:
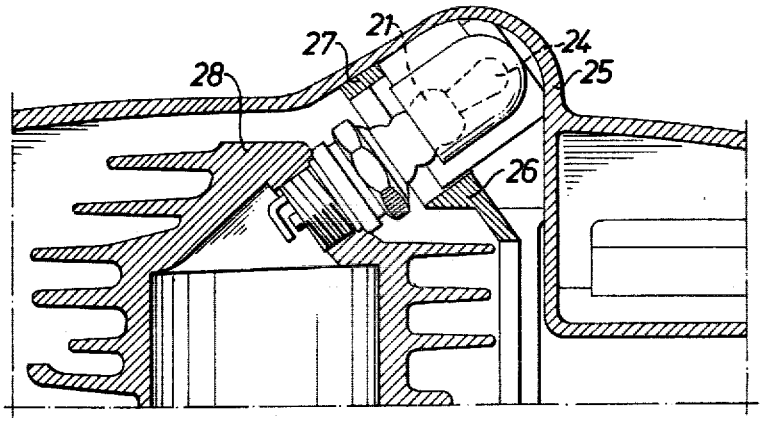
FIG. 5 shows the device mounted in a chainsaw casing.

In FIG. 5, the coil is shown fitted in a casing 25 to a chainsaw, between a support 26 and a further support 27, which laterally act on the portion of the elastic body denoted by the numeral 15 in FIG. 1. The plug 21 is fitted to an engine cylinder 28. The low-tension wires 4 and 5 of the coil are connected, in a way not shown, to the coil 2 of a magneto apparatus. The plug is here held rigidly with respect to the engine and thus oscillates with it in its rubber suspension. However, the coil is attached between the supports 26 and 27 in the frame 25. This attachment is not entirely rigid, since it acts against the body 15. The sleeve portion 18 forms, as mentioned previously, a portion which is flexible in relation to the plug 21 and allows the latter to move with the engine. Both the plug and the coil can be effectively built inside the casing of a chain-saw without any extra cables needing to be drawn or fished, apart from the low-tension wires 4, 5, and complete moisture-proofing is obtained to the same extent as is the case with a unified assembly of the plug and coil. Standard spark plugs can furthermore be used with the present invention, which is a big advantage from the point of view of service. Neither is there any risk of injurious heat conduction to the coil in such an arrangement.

Figure 6:
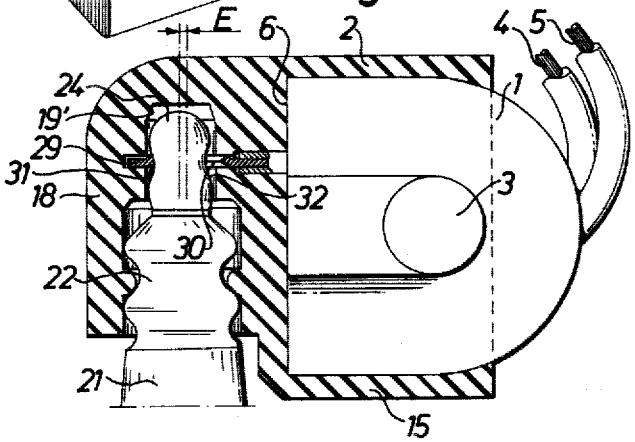
FIG. 6 is a longitudinal section of a second embodiment of the invention.

The embodiment shown in FIG. 6 is provided with a contact clip means or terminal which is different from the one above described. From the end surface 6 a leaf spring or apertured terminal blade 29 projects into the cavity 19, perpendicularly to the longitudinal axis thereof into an opposite wall portion of the sleeve 18, the cavity 19' being narrower than the cavity 19. The spring or terminal 29 is has a hole 30 having a diameter which permits the contact terminal 24 of the spark plug to be inserted therein. Further the spring or terminal 29 is firmly fixed to the ignition coil casing 1 and thus is not movable in its longitudinal direction. The cavity 19' has a diameter which is adapted for receiving the spark plug terminal 24. In the inserted position shown in FIG. 6 of the ignition coil and the contact terminal into the cover 15 the distance between the wall 6 and the center of the spring hole 30 is shorter than the distance between said wall 6 and the longitudinal axis of the cavity 19'. This relationship causes the hole 30 to be eccentrically situated relatively to the longitudinal axis of the cavity, the amount of the eccentricity being indicated by E in FIG. 6. Said eccentricity causes the outermost edge portion 31 of the hole 30 to come into contact with the narrower part 32 of the contact terminal 24 because the opposite wall portion of the cavity 19' pushes the terminal 24 into said contact condition. The center of oscillation with regard to the spark plug relatively to the ignition coil is in the said embodiment essentially around the area defined by the crossing between the longitudinal axis of the cavity 19' and the plane of the leaf spring, which gives the desired degree of freedom and at the same time a good contact. The contact spring or terminal may in accordance with the requirements and conditions be made rigid or resilient.

A plurality of embodiments can naturally be conceived within the purview of the invention. It is thus not necessary that the contact clip itself is made in the way shown, and the high-tension connection can be made with other connecting means than what has been shown here, although the ones shown are extremely advantageous. A regard to the type of spark plug used must naturally take place, e.g. by forming the ridges 20 in a suitable way. The sleeve portion 18 can naturally be more elongate than what has been shown here, and the body 15 can be formed to enclose the whole of the ignition coil. If necessary, the elastic body 15 can be provided with attachment flanges for coaction with a frame portion or the like in some device built together with an engine.

What is claimed is:

1. An ignition coil for use with a spark plug, having an insulator portion, comprising:

(a) a coil;

(b) a contact terminal having an opening and projecting from said coil and connected to provide a high voltage therefrom, said terminal being adapted to form a connection with the spark plug;

(c) an elastic body only partially surrounding said coil and slidably detachable therefrom, said body having a portion extending as a closed sleeve in surrounding eccentric relationship to said terminal opening and receptive of and engageable with the insulator portion of the spark plug at its open end for providing a seal therewith and, said body being adapted to provide a sprung coaction acting transversely to the terminal of the spark plug for thus keeping the coil and spark plug together as a unit and for locking said slidably detachable elastic body to said coil.

2. An ignition coil according to claim 1, said contact terminal comprising two parallel wires projecting from said coil, and symmetrically branching out laterally in an undulating manner to form a resilient clip for embracing the terminal of the spark plug, the wires merging into a loop directed toward said coil and engageable with the end of the spark plug terminal.

3. An ignition coil according to claim 1, said contact terminal comprising a sheetmetal blade projecting across a cavity in said sleeve, said blade having a hole receptive of the terminal of the spark plug, said hole and the longitudinal axis of said cavity being nonconcentric in the fully assembled relation of said elastic body with the coil, whereby said elastic body is enabled to bias the spark plug terminal against an edge portion of said hole.

4. An ignition coil according to claim 3, said elastic body having an inner wall against which said coil is drawn by the spark plug's acting on said terminal blade, said sleeve portion having an axis extending parallel to said wall and being formed integrally therewith, said wall having an opening extending perpendicularly to the axis of said sleeve portion and through which said terminal projects.

5. An ignition coil according to claim 4, including a casing of comparatively hard moisture-proof material molded onto said coil, said casing having a flat side lying substantially parallel to the axis of said coil and in engagement with said elastic wall in radially spaced relation to said sleeve portion.

* * * * *